US006184909B1

(12) United States Patent
Matsuno et al.

(10) Patent No.: US 6,184,909 B1
(45) Date of Patent: Feb. 6, 2001

(54) RECORDING APPARATUS WITH ROTATABLE LIQUID DEVELOPER UNITS ENABLING AGITATION OF LIQUID DEVELOPER

(75) Inventors: Junichi Matsuno, Tsuchiura; Shogo Matsumoto; Akira Mori, both of Ibaraki-ken; Keiji Kamio; Mitsuo Suzuki, both of Hitachi, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 09/146,350

(22) Filed: Sep. 3, 1998

(30) Foreign Application Priority Data

Sep. 10, 1997 (JP) ..... 9-245027

(51) Int. Cl.[7] ..... G03G 15/10; G03G 15/01
(52) U.S. Cl. ..... 347/115; 399/227; 399/233
(58) Field of Search ..... 347/115, 120, 347/158; 399/57, 227, 233; 430/117

(56) References Cited

U.S. PATENT DOCUMENTS 4,728,987 * 3/1988 Diola et al. ..... 399/227
5,832,334 * 11/1998 Corn et al. ..... 399/57

* cited by examiner

*Primary Examiner*—Joan Pendegrass
(74) *Attorney, Agent, or Firm*—Antonelli, Terry, Stout & Kraus, LLP

(57) ABSTRACT

Provided a color recording device for developing a color image with the use of liquid developer in which toner is dispersed, in which liquid developer having a high toner density is preferably used for printing a fine image, which however causes a problem of precipitation of toner or the like. Thus, at least four liquid type color developing units using liquid developer having a high toner density of 5 to 35% are arranged on a rotary base which is rotated so that the developing units are changed over so as to be respectively opposed to a recording medium, and each of the developing units is composed of a cartridge bottle in which the liquid developer is pooled, a supply passage for supplying the liquid developer pumped up from the cartridge bottle onto a pump-up roller for feeding the liquid developer pumped up onto a developing roller. The supply passage can supply a regulated quantity of the liquid developer in association with the rotation of the rotary base.

6 Claims, 6 Drawing Sheets

RECORDING APPARATUS WITH ROTATABLE LIQUID DEVELOPER UNITS ENABLING AGITATION OF LIQUID DEVELOPER

BACKGROUND OF THE INVENTION

The present invention relates to a recording apparatus for recording data after a density gradation process for every pixel, and in particular relates to a recording apparatus which develops a latent image including a halftone with a high degree of loyalty by using liquid developer so as to obtain an image of high quality with the use of microparticle toner.

For example, Japanese Laid-Open Patent No. H7-334004 discloses a conventional apparatus in which wet-type liquid developer is circulated through a feed pipe and a return pipe so as to prevent build-up and deposition of the liquid developer in order to prevent the tone from varying through the development and to effect an agitating function.

Further, Japanese Laid-Open Patent No. H5-35117 discloses another conventional recording apparatus in which a developer bottle is shifted left and right in order to agitate developer having a high density.

A conventional wet-type developing device using electrostatic liquid developer has been well-known as is disclosed in "Basic and Applied Electrophotographic Technology" edited by Electrophotographing Association, pages 288 to 277, issued in 1998 by Corona Co.

That is, there have been well-known liquid type developing apparatuses having a dish development system in which an image bearing medium carrying a latent image is dipped in liquid developer filled in a developing dish for developing the latent image, a roller development system in which a developing roller formed on its outer peripheral surface with a thin film of electrostatic liquid developer is approached by an image bearing medium carrying a latent image for developing the latent image, and a slit development system in which an image bearing medium is sucked by grooves formed in opposite end parts of a developing part and connected to a vacuum source, and liquid developer is drawn from a slit formed in the center part of an electrode so as to be circulated between the electrode and the image bearing medium for developing a latent image thereon when negative pressure is effected in the developing part. The above-mentioned wet-type developing apparatus requires in general a liquid developer circulating system for feeding and retrieving liquid developer, causing a disadvantage in that the developing device using liquid developer becomes large-sized and complicated.

Meanwhile, there has been known a rotary developing apparatus using dry type developer, in which a plurality of developing units circumferentially arranged and carried are rotated cicumeferentially, and the circumferential rotation of each of the developing units is stopped at a developing position where the developing unit faces an image bearing medium so that the developing unit located at the developing position develops a latent image carried on the image bearing medium.

For example, Japanese Laid-open Patent No. H8-305119 discloses a rotary type developing device having such a feature that there is in particular provided means for rotating a developer carrier in a developing unit at a position other than a developing position.

In the above-mentioned conventional technologies, a toner liquid developer having a weight rate of less than 1% can easily be circulated by using a pump so as to possibly redisperse the toner. However, the higher the toner density, the more the circulation would become difficult, and the toner having deposited, can hardly be drawn up even though it is sucked up by a pump using a pipe. Further, if the toner density is low, there is offered such a problem that a fine image can not be obtained.

Meanwhile, in the case of liquid developer having a high density, which require oscillating a developer bottle left and right, the redispersion of toner which have once deposited onto the bottom of the bottle is difficult, and acceleration during movement is required for enhancing the effect of the redispersion while it is moved left and right. This causes a problem of requiring a high power drive source for vibrating and moving the apparatus.

SUMMARY OF THE INVENTION

One object of the present invention is to provide a recording apparatus incorporating a liquid developing unit using a high density liquid developer and being capable of printing a highly fine color image.

To the end according to the present invention, cartridges containing therein liquid developers having a high density of 5 to 35%, and a developing roller are arranged on a rotary base, and color developing units are positioned by rotating the rotary base for developing while supplying and recovering liquid developer.

In particular, after a long stand-by time or a long interruption, the rotary base is rotated by at least a half-turn just before initiation of recording.

Accordingly, by rotating a rotary body attached thereto four color developing units using high density liquid developers containing 5 to 35 wt. % of toner just before recording, the toner which has even precipitated and agglutinated in the liquid developers, depositing on the bottoms of the cartridges, can be redispersed in the liquid developers since the cartridges become once upside down, that is, the bottom surfaces of the cartridges are once turned into the top surfaces through the rotation by a half-turn, thereby it is possible to satisfactorily disperse the toner in the liquid developer during recording. Simultaneously, a predetermined quantity of liquid developer can be supplied to the developing roller part while the liquid developer remaining on the developing roller part can be recovered.

Further, developing parts and cleaning parts are provided outside of but adjacent to a circumscribed circle depicted by the color developing units during rotation while the color developing units are stopped, as necessary, at the positions of the developing parts and the cleaning parts. In the case of the four color developing units arranged at angular intervals of 90 deg. on the rotary base, each of the color developing units can be shifted from the associated developing part to the associated cleaning part through the rotation by a quarter turn, and further, the recovery of the liquid developer and the closing of developer tanks are carried out in relation to the rotating positions of the developing units. With this arrangement, the developing can be reliably made even with high density liquid developer, and by rotating the rotary base, the developing, the cleaning and the recovery of liquid developer can be selectively made, thereby it is possible to provide an inexpensive developing device.

By the way, in the case of a developing device in which no liquid developer is circulated, and which has no density control mechanism, it is necessary to set a toner density in accordance with an averaged printing rate. The ratio between a toner adhering area and a printing area on a recording medium, which corresponding to the averaged printing rate, is estimated to 3 to 30% in the case of printing a photographic tone image, the density of the liquid developer can be set such that the degree of solvent consumption in the liquid developer is substantially equal to the degree of toner consumption with this printing rate.

DESCRIPTION OF THE PREFERRED EMBODIMENTS

Explanation will be made of preferred embodiments of the present invention with reference to FIGS. 1 to 8.

Figure 1:
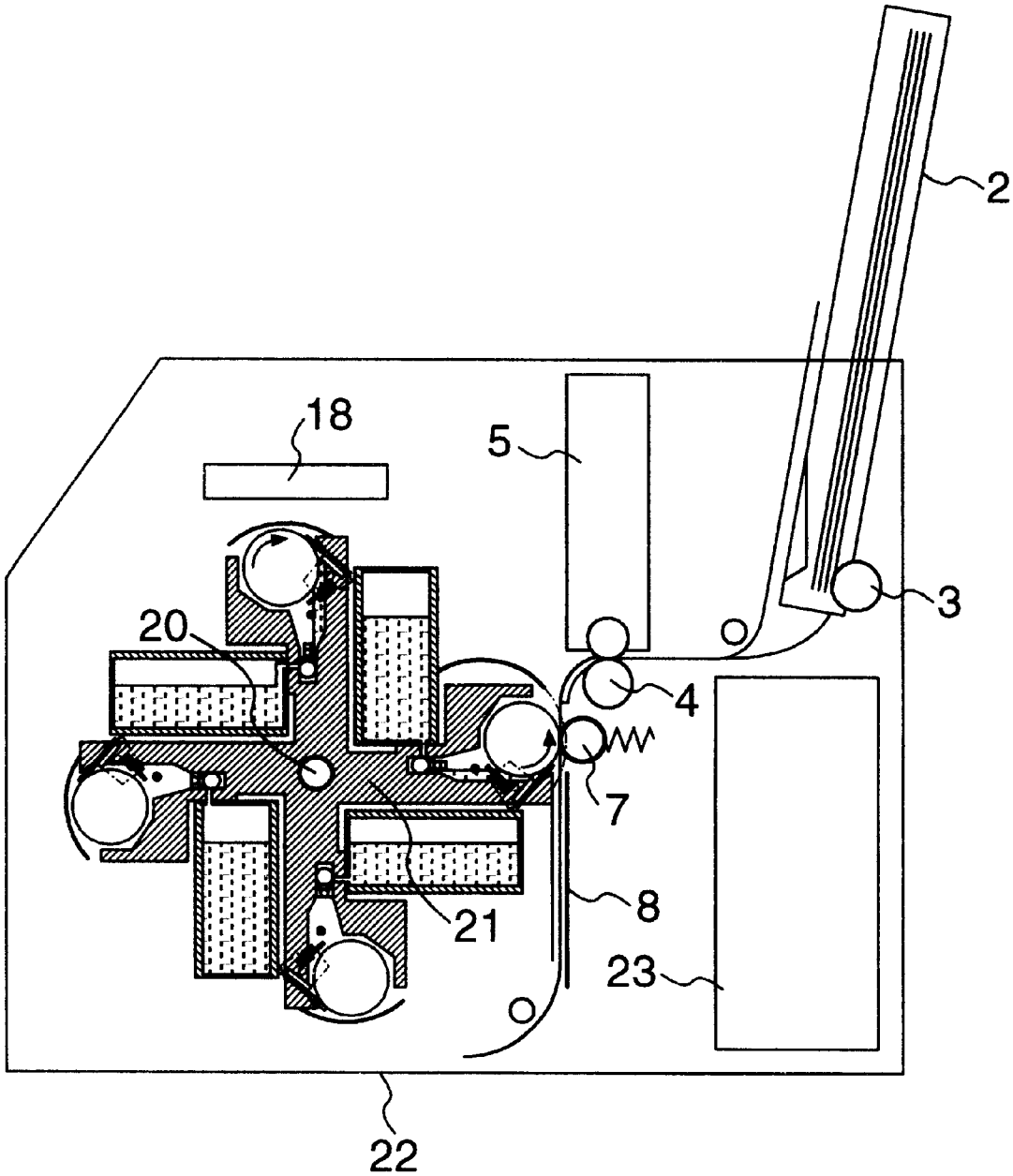
FIG. 1 is a schematic structural view illustrating a recording apparatus according to the present invention.

Referring to FIG. 1 which shows a recording apparatus in an embodiment of the present invention, in such a condition that the apparatus in which recording sheets 1 have been set in a hopper 2 stands by for receiving a record starting instruction from a computer 23, when the instruction is received, a paper feed roller 3 is rotated so as to separately feed the recording sheets 1 one by one which are then fed by paper feed rollers 4 which clamp each of the recording sheets only at opposite ends thereof in order to precisely feed the recording sheet 1. When the recording sheet 1 clamped by the feed rollers 4 reaches recording start position which is not shown, a head 5 in the vicinity of the rollers 4 starts recording of an electrostatic latent image with a first color.

Further, when the record starting instruction is received, a control device on the recording apparatus side, which is not shown, determines whether the stand-by time up to that time is longer than a predetermined time or not or whether the instruction is an initial record starting instruction or not. If it is true, a drive control device which is not shown controls the rotation of a motor provided in a developing unit housing 21 as a rotary base in order to rotate the developing unit housing by a degree which is larger than a half-turn. Thus, if the developing device is not operated for a long time, the developing units are rotated before the recording is started, and accordingly, toner which has precipitated in the gravitational direction in liquid developer within cartridges can be sufficiently dispersed even though the precipitation or agglutination occurs in the liquid developer, thereby it is possible to carry out highly fine printing.

For example, the record starting position is set so as to be just after a position such that the leading end of the recording sheet 1 which is clamped by the paper feed rollers 4, passes through the ion flow head 5. Such positioning can be also made, in accordance with a degree of paper feed measured by an optical reflection type sensor which is not shown, or a signal from an optical reflection type sensor which is provided in the vicinity of the head 5.

When the recording sheet 1 is clamped by the paper feed rollers 4, the recording sheet 1 is released from the paper feed roller 3 in order to reduce the carrier load.

Figure 8:
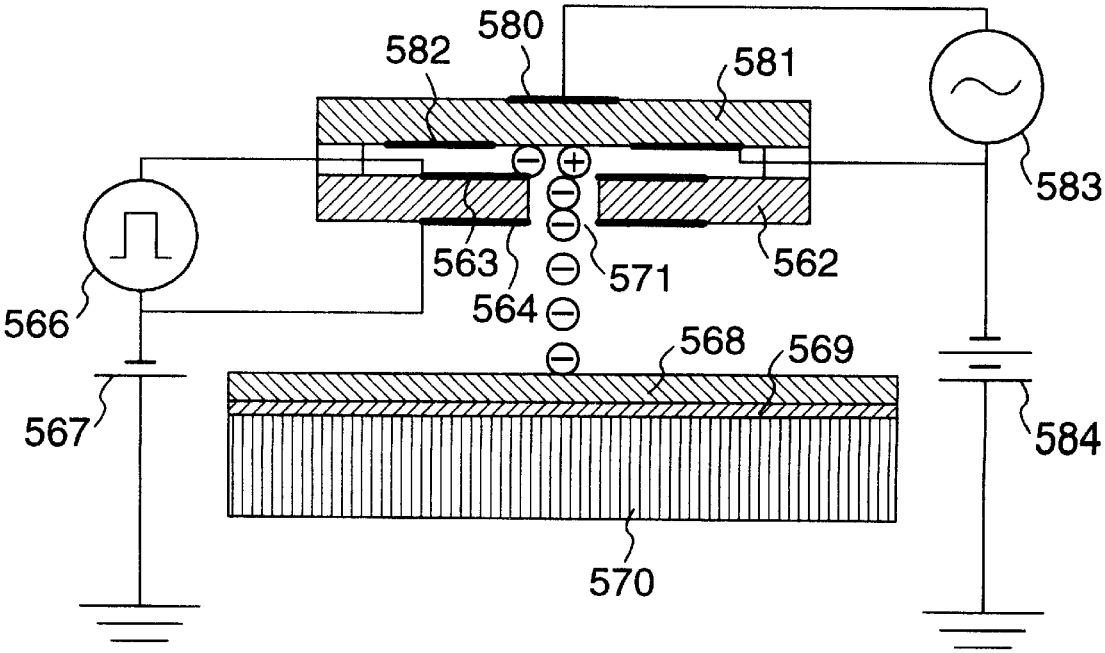
FIG. 8 is a view illustrating an embodiment of an ion flow head.

Next, explanation will be made of creation of a latent image on the recording sheet 1. Referring to FIG. 8 which shows an embodiment of an ion flow head, the recording head 5 serves as an ion source which is composed of a solid discharge electrode which is composed of an upper and lower electrodes 580, 582 and a solid discharge dielectric layer 581 which interposed therebetween. When a high voltage is applied between the upper and lower electrodes from an a.c. power source 583, plus and minus ions are generated. Next, a voltage from a bias power source 567 is applied to a first control electrode 563 and a second control electrode 564 between which a dielectric film 562 having a through hole 571 is interposed, in response to a control signal 566 from a computer which is not shown, so as to selectively apply only the minus ions over the recording sheet in order to create an electrostatic latent image. The recording sheet 1 is composed of a recording sheet base material on which a conductive layer 569 and a dielectric layer 568 are laminated, and accordingly, an electrostatic latent image can be created on the dielectric layer.

When the recording of the electrostatic latent image is started on the recording sheet 1, for example, yellow recording is at first carried out. The developing unit housing 21 is rotated by a developing roller for yellow so as to be stopped at a developing position in order to regulate a gap between the developing roller and the recording sheet 1, and then the yellow developing is initiated. Alternatively, a guide roller 7 arranged at the developing position is slightly shifted so as to regulate a gap between the developing roller and the recording sheet 1, and then the yellow developing is initiated. The gap between the developing roller and the recording sheet 1 during developing, is such that they may be made into contact with each other by a light force, but the developing roller is required to be supported so as to be free in rotation. Thus, the outer surface of the developing roller is formed of a soft elastic layer in order to allow the contact force therebetween to be small. It is noted that a magenta developing unit and a cyan developing unit in addition to the yellow developing unit are also provided in the developing unit housing 21, as shown, in order to carry out magenta (M) developing and cyan (C) developing.

Just before the trailing end of the recording sheet 1 leaves from the paper feed rollers 4, the creation of an electrostatic latent image, and the developing thereof are completed. The recording sheet 1 is then heated and dried by a heating means such as a sheet heater 8, and accordingly, a toner image is fixed on the recording sheet 1.

Thereafter, the developing unit housing 21 is rotated so as to separate the yellow developing unit from the developing part, and further, conveying rollers which are not shown and which are provided downstream of the sheet heater 8, and the paper feed rollers 4 are rotated in the reverse direction so as to feed the recording sheet 1 in the reverse direction up to a position where the developing of a latent image with a second color is started. Simultaneously, a developing roller for the second color such as magenta is positioned in the developing part.

The recording of the latent image for the second color such as magenta is started over the yellow image on the recording sheet 1, similar to the developing of the first color or yellow, in response to an image signal for the second color. Thus, the developing for magenta is carried out, similar to the yellow developing.

Before explanation is made of a third color recording, explanation will be made of the structure and operation of the developing unit with reference to FIG. 2.

Liquid developers and developing rollers for the respective colors are installed in the developing unit housing 21 which is then rotated. A Y-liquid developer cartridge 62 is filled with yellow Y-liquid developer 63, and thereafter, it is fixed to the developing unit housing 21. Then, it is communicated with a developer inlet hole 60. At this time, the Y-liquid developer 63 is blocked by a Y-ball 59.

When the Y-ball 59 is displaced by rotating a Y-ball cam 58, the Y-liquid developer 63 flows into the lower part of the Y-developing roller 52 through the Y-liquid developer inlet hole 60. The quantity of the Y-liquid developer 63 is controlled to a regulated value by detecting the quantity of the Y-liquid developer 63 with the use of a Y-liquid developer sensor 57, and then by rotating the Y-ball cam 58 so as to replace the Y-ball 59 in order to block the Y-liquid developer 63.

During the developing, a Y-cover 53 is, of course, retracted. Then, the Y-developing roller 52 is rotated while A Y-blade 54 is made into contact with the Y-developing roller 52 so as to uniformly form a thin film of the Y-liquid developer on the Y-developing roller 52.

By the way, the Y-blade 54 is secured to the Y5 blade fixing plate 55, and is made into contact with the Y-developing roller 52 when the Y-blade fixing plate 55 is rotated. Further, A-scraper blade 56 is also fixed to the Y-blade fixing plate 55, and is separated from the Y-developing roller 52 when the Y-blade 54 is made into contact with the Y-developing roller 52. Meanwhile, the Y-scraper blade 56 is made into contact with the developing roller 52 when the Y-blade 54 is separated from the Y-developing roller 52. With this arrangement, the Y-liquid developer 63 remaining on the Y-developing roller 52 is recovered by rotating the Y-blade fixing plate 55.

Figure 2:
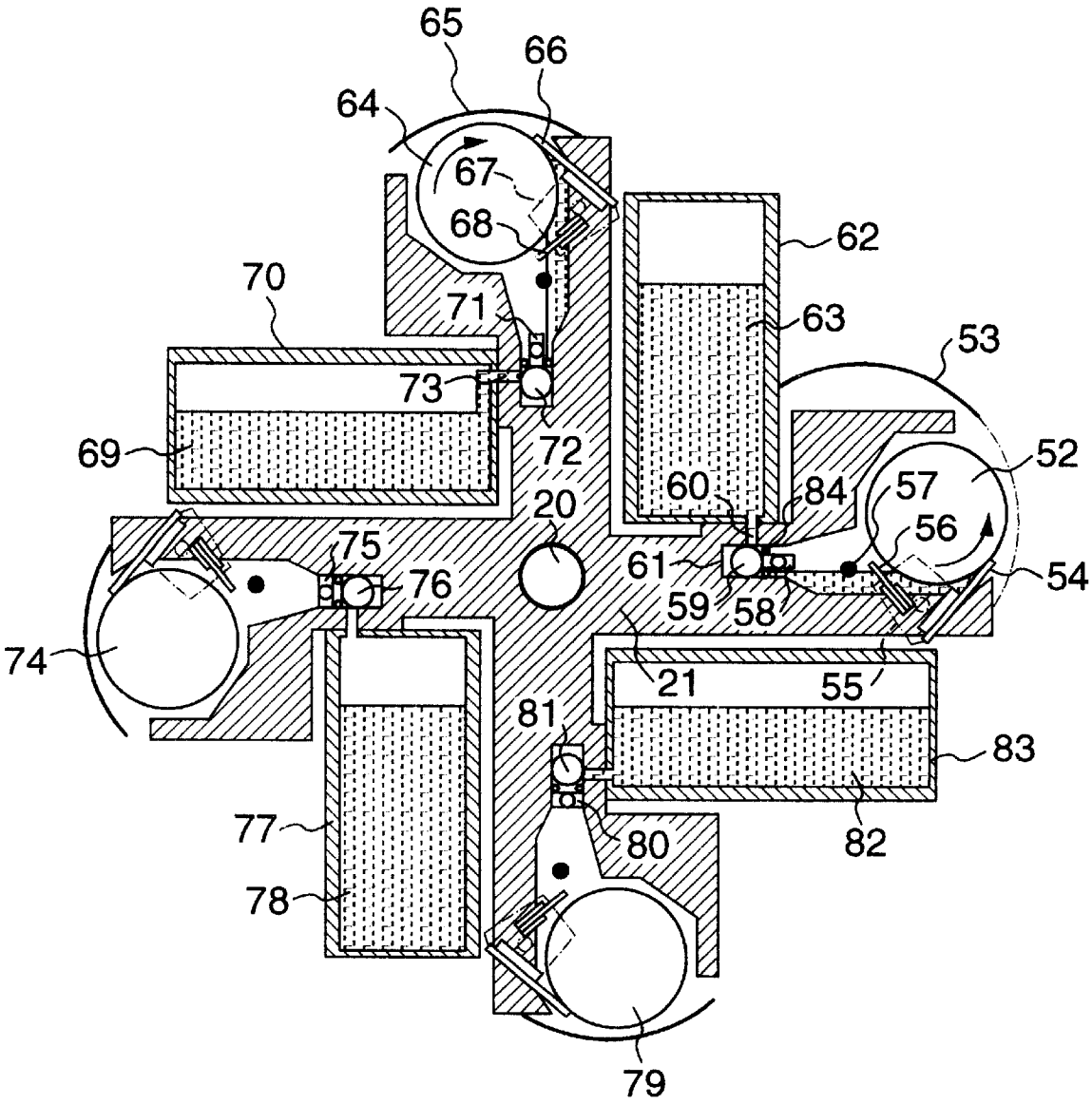
FIG. 2 is a structural view in an embodiment of a developing device.

FIG. 2 shows a condition in which the Y-developing is carried out. Explanation will be hereinbelow made, estimating that the developing for a preceding page has been completed before the Y-developing is started, and the developing lastly carried out for the preceding page is K-developing.

The recovering of the liquid developer is started when the developing unit housing 21 is rotated around the rotary shaft 20 so as to reach a position thereabove. At this time, the rotating direction of the developing roller may be either clockwise or counterclockwise. After K-liquid developer 69 remaining on a K-developing roller 64 is substantially scraped off, a cleaner 18 provided on the K-developing roller 64 surely cleans the latter.

Thereafter, the K-developing roller 54 is covered thereover with a K-cover 65 so as to protect the roller 54 against dust. Meanwhile, a K-liquid developer 69 counterflows and is returned into the K-liquid developer tank since the K-developing roller is moved upward. It is noted that dust such as paper dust is filtered in order to prevent the dust from entering the K-liquid developer cartridge 70 upon the counterflowing. After the remaining K-liquid developer 69 is recovered, a k-ball cam 71 is rotated so that a K-ball 72 is pressed against an O-ring 84 (which is seen in the Y-developing unit and which is also provided in each of the K-developing unit, C-developing unit and M developing unit) so as to close the K-liquid developer cartridge 70. In this condition, the developing device stands by for next developing.

The other developing such as M-developing and C-developing are similarly carried out. Explanation will be made of components in the M-developing unit and C-developing unit. The developing unit housing 21 includes a C-developing roller 74, a C-ball cam 75, a C-ball 76, an M-developing roller 79, an M-ball cam 80 and an M-ball 81, and is adapted to be attached with a C-liquid developer cartridge 77 filled therein with C-liquid developer 78 and a M-liquid developer cartridge 83 filled therein with M-liquid developer 82. In this embodiment, the supply quantity of liquid is regulated by a valve composed of a cam, a ball and a spring. The rotation of the cam can be synchronized with the rotation of the developing unit housing.

Figure 3:
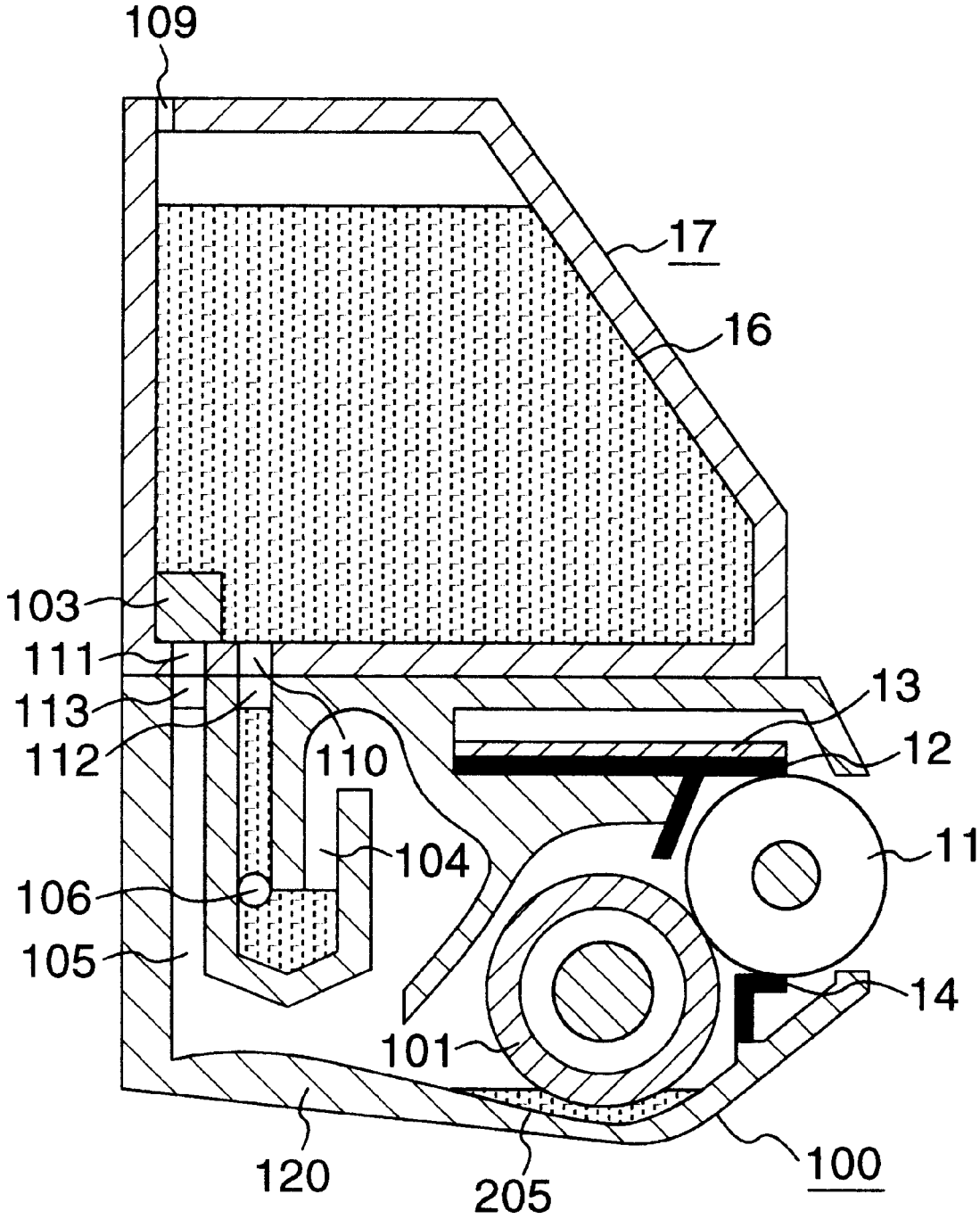
FIG. 3 is a structural view illustrating an element in another embodiment of the developing device.

Next, explanation will be made of developing device in other embodiments with reference to FIGS. 3 and 4. FIG. 3 is one of the other embodiments in particular, in a developing condition.

Referring to FIG. 3, the developing unit is mainly composed of a liquid developer cartridge 17 and a developing unit 100, liquid developer 16 being held in the liquid developer cartridge 17. Further, at least one porous membrane 109 having several micropores is provided in the liquid developer cartridge 17, and accordingly, air can flows into the cartridge from the outside, but the liquid developer 16 cannot flows out from the cartridge 17. Accordingly, the pressure of air in the liquid developer cartridge 17 is held to be equal to the atmospheric pressure. Reason why the porous membrane 109 is provided, is such that the pressure of air in the liquid developer cartridge 17 is set to be equal to the atmospheric air as mentioned above. Accordingly, a similar effect can be obtained by a liquid developer holding bag which is soft and easily deformable and which is provided in the liquid developer cartridge 17.

Further, in this embodiment, there are provided two holes, that is, a supply hole 110 and a recovery hole 111 (in general, only one communication hole has been provided), and a counterflow preventing valve 3 for preventing the liquid developer 16 from leaking out from the liquid developer cartridge 17 is provided in the recovery hole 111 on the inside of the liquid developer cartridge 17. Although in this embodiment, the counterflow preventing valve 103 is provided in the liquid developer cartridge 17, this may be provided in the developing unit 100.

The developing unit 100 is composed of a developing roller 11, a pump-up roller 101 for pumping up the liquid developer onto the developing roller 11, a developing blade 12 for forming a thin film of the liquid developer on the outer periphery of the developing roller 11, a blade fixing plate 13 for fixing the developing blade 12, a scraping blade 14 for scraping the thin film of the liquid developer on the outer periphery of the developing roller 12 after developing, a float valve 106 and a developing unit housing 120.

It is noted that the developing unit housing 120 is formed therein a supply hole 112 and a recovery hole 113 respectively corresponding to the supply hole 110 and the recovery hole 111 of the liquid developer cartridge 17. Further, due to the shape of the developing unit housing 120, as shown in FIG. 3, a supply passage 104 and a recovery passage 105 are defined therein, the float valve 106 being located in the supply passage 104. The developing roller 11 is a metal roller, and the pump-up roller 101 is a rubber roller. Thus, the shape of the supply passage 104 is complicated in comparison with the arrangement shown in FIG. 2, The supply quantity of liquid developer can be set to be substantially constant, and a float type valve can be used, thereby it is possible to reduce the number of necessary components.

During developing, the developing roller 11 is rotated clockwise by a gear which is not shown while the pump-up roller 101 is rotated counterclockwise, following the rotation of the developing roller 11. Thus, the liquid developer is pumped up from a liquid developer sump 205 through the rotation thereof, and is fed onto the developing roller 11. The thus fed liquid developer is formed into a thin film having a predetermined film thickness on the outer periphery of the developing roller 11 by means of the developing blade 12 through the rotation of the developing roller 11. After an electric latent image is developed, the thin film of the liquid developer is scraped off by the scraping blade 14, and accordingly, the liquid developer is returned into the liquid developer sump 205. In this embodiment, the liquid developer cartridge and the developing unit 100 can be separated from each other. However, they may be integrally incorporated with each other.

Next, how the liquid developer is fed by a predetermined quantity through the rotation, and how the liquid developer is recovered, will be explained in examples of the arrangement of the developing unit shown in FIG. 3 and a full color rotary liquid type developing unit shown in FIG. 4.

In these figures, a cyan color developing unit is located. A rotary developing device 150 is composed of a cyan color developing unit 151, a black color developing unit 152, a yellow color developing unit 153 and a magenta color developing unit 154 which are arranged at equal intervals on a developing unit housing 21 serving as a rotary base around a rotary shaft 20, their postures being circumfrentially changed at angular intervals of 90 deg. It is noted that the developing units are provided so that the distance between the center of the rotary shaft 20 and the outer periphery of the developing roller 11 becomes largest. This is because the components constituting the developing units other than the developing roller are prevented from making contact with or bumping upon a latent image bearing medium due to the rotation of the developing unit housing 12. In FIG. 4, the developing is carried out at a cyan color developing position 151.

Figure 4:
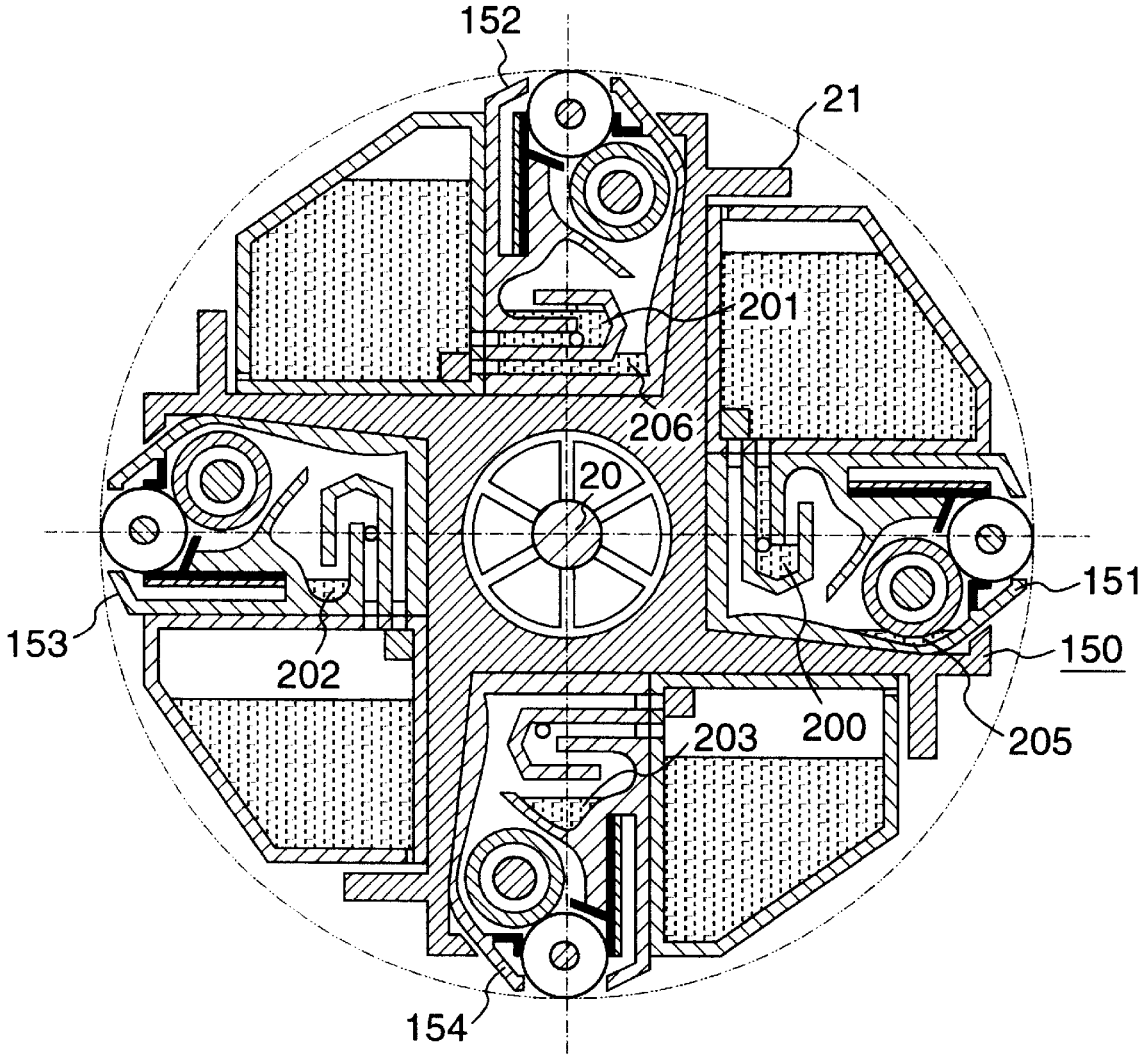
FIG. 4 is a view illustrating the developing device shown in FIG. 3.

Referring to FIG. 4, the rotary shaft 20 is driven by a drive shaft which is not shown, so as to rotate the rotary developing device 150 counterclockwise as shown in FIG. 4, and accordingly, the color developing units are rotated in order to replace the developing unit at the developing position with another one.

When the developing device takes the position of the cyan color developing unit 151 in FIG. 4, the supply hole 110 formed in the liquid developer cartridge 17 and the supply hole 112 formed in the developing unit housing 120 define a communication part through which the liquid developer 16 flows from the liquid developer cartridge 17 into the flow passage 104 formed in the developing device 100. When the liquid developer is pooled in the developing device up to a level indicated by 200, the float valve 106 provided in the supply passage 104 blocks the supply flow passage so as to shut off the inflow of the liquid developer, and accordingly, no more liquid developer cannot flows into.

Instead of the float valve 106, a solenoid shut-off valve may be used. Alternatively, the ball and spring mechanism in other embodiments as mentioned above, may be used. In this case, after completion of recording, the rotary unit 150 is rotated counterclockwise in FIG. 4 while the valve is held to be closed, the liquid developer can be merely recovered from the developing device 100 without the supply of the liquid developer from the liquid developer cartridge 17.

Next, when the developing device is moved to the position of the black color developing unit 152 through the rotation, the liquid developer 201 in the supply passage 104 is held at 201. At this time, the porous membrane 109 provided in the liquid developer cartridge 17 is blocked by the liquid developer 16 so as to prevent air from flowing into the liquid developer cartridge 17. Accordingly, even though the float valve 106 does not block the supply passage 104, the liquid developer 16 can be prevented from flowing into the developing device 100. Should air flow into the developing device through the supply passage 104, the float valve 106 may block the supply flow passage even at this position so as to surely prevent the liquid developer 16 from leaking.

Further, when the developing device comes to the position of the yellow color developing unit 153 through the rotation, the liquid developer in the supply passage 104 is held at a position indicated by 202, and a part of the liquid developer counterflows in the supply passage and is returned into the liquid developer cartridge 17.

Further, when the developing device is again rotated so that it comes to the position of the magenta color developing unit 154, the liquid developer held at 202 is displaced through the rotation, and is then held at the position 203.

Further, the developing device is again rotated once more so that the developing device returned to the initial developing position, that is, the position of the cyan color developing unit 154, the liquid developer held at 203 is fed into the liquid developer sump 205. With the use of this liquid developer pooled in the liquid developer sump 205, the electrostatic latent image on the latent image bearing medium is developed by the developing roller 11.

Next, the liquid developer remaining in the liquid developer sump 205 after completion of the developing, is displaced into the recovery passage 205 along the wall of the developing device 100 during the movement of the developing unit 100 to the position of the black color developing unit 152, and is then held at a position 206. In this condition, air is prevented from flowing into the liquid developer cartridge 17 from the recovery passage 105 due to the provision of the counterflow preventing valve 103. Accordingly, the liquid developer 16 can be prevented from flowing into the recovery passage 105 from the liquid developer cartridge 17.

When the developing device is further rotated so as to come to the position of the yellow developing unit 153, the liquid developer held at 206 is recovered into the liquid developer cartridge 17 through the counerflow preventing valve 103 which is opened. Further, the liquid developer 16 in the liquid developer cartridge 17 is agitated through the rotation of the rotary developing device 150.

Figure 5:
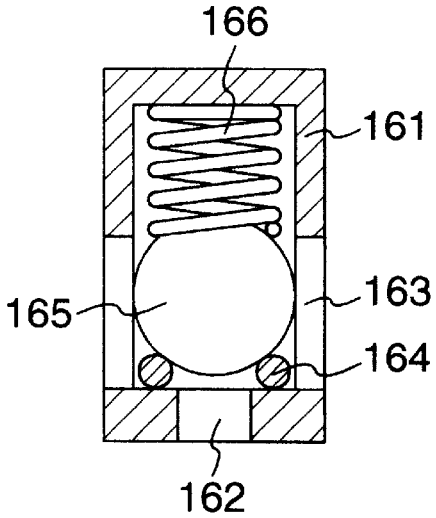
FIG. 5 is a structural view illustrating a counterflow preventing valve provided in the developing device.

FIG. 5 is a detailed view which shows the counterflow preventing valve 103.

A housing 161 is formed therein with a communication hole 162 corresponding to the recovery hole 111, and a communication hole 163 for the liquid developer cartridge 17. The housing 161 is provided with an O-ring 164 against which a ball 165 is pressed by a compression spring 166 having one end making contact with the ball 165 and the other end making contact with the housing 161.

When the developing device is located at the position of the yellow developing unit 153 as shown in FIG. 4, the compression spring 166 is compressed by the weight of the ball 165 which is therefore separated from the O-ring 164, and accordingly, the communication passage communicating between the communication holes 162, 163 is ensured. Thus, the liquid developer held in the recovery passage 105 is returned into the liquid developer cartridge 17. When the developing device is located at any of the positions of cyan color developing unit 151, the black color developing unit 152 and the magenta color developing unit 154, the ball 165 is pressed against the O-ring 164 by the restoring force of the compression spring 166. Thus, the communication between the communication holes 162, 163 is shut-off, and accordingly, the liquid developer is prevented from counterlowing from the liquid developer cartridge 17 into the recovery passage 105.

Next, another embodiment of the recording apparatus will be explained with reference to FIG. 6.

The arrangement mentioned above has a such an arrangement that an electrostatic latent image can be directly formed on the recording sheet 1 by the recording head 5. That is, the recording sheet to be used is an exclusive sheet having a three layer structure composed of a conductive layer and a dielectric layer laminated on a recording base material.

Figure 6:
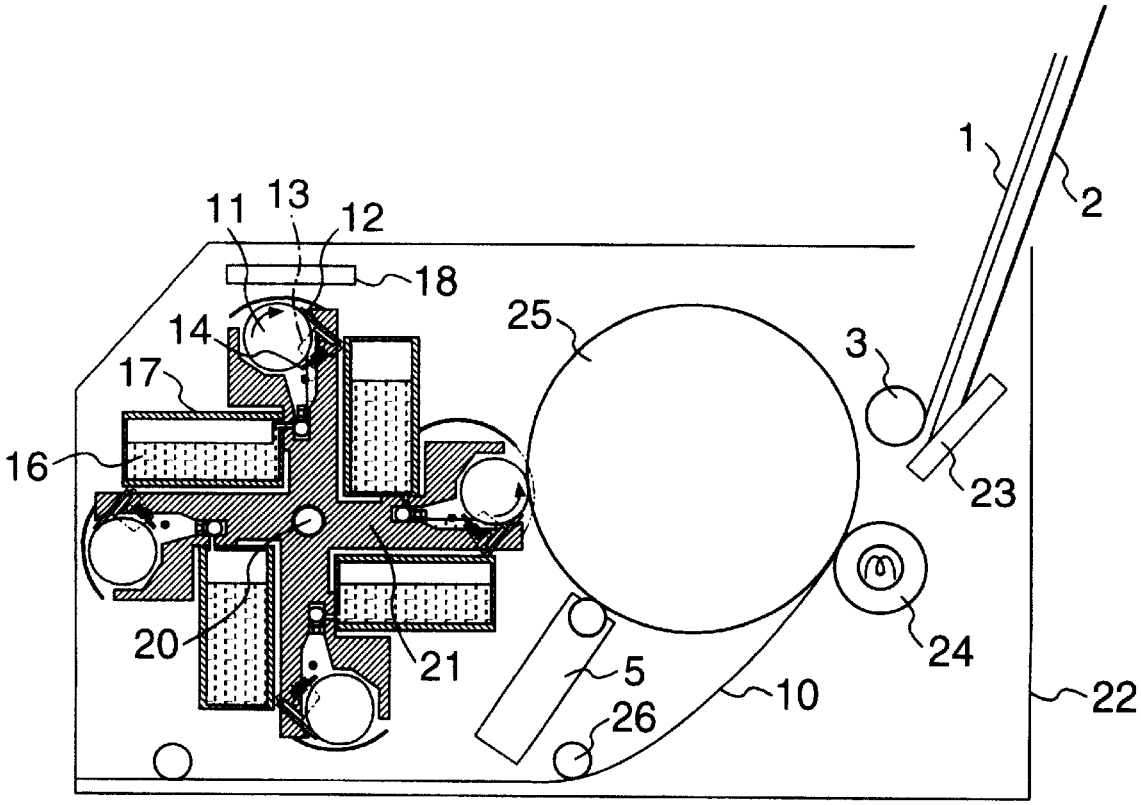
FIG. 6 is a schematic structural view illustrating another embodiment of the recording apparatus according to the present invention.

In the case of a general sheet, instead of the exclusive sheet, as shown in FIG. 6, images such as four color images are once formed in a dielectric drum 25 on which an electrostatic latent image can be formed, successively, and thereafter, these color images are transferred onto the recording sheet 1 by means an image transfer roller 24 incorporating a heating means.

Electrostatic latent images corresponding to image data are formed on the dielectric drum by the recording head 5, and are then developed by the color developing units. This process is repeated by four times, an color image is created on the dielectric drum 25. Then, the recording sheet 1 which has been separated from other sheets is conveyed to the image transferring position by the paper feed roller 3.

The image transfer roller 24 which has been heated just before the image transfer, presses the dielectric drum 25 with such a first timing that the recording sheet 1 intervenes between the dielectric drum and the image transfer roller 24. The recording sheet 1 is heated and is pressed against the surface of the image which is therefore transferred onto the recording sheet 1.

The recording sheet 1 onto which the image is transferred, is discharged from the apparatus by the guide roller 26.

Thus, by rotating the four color developing units installed on the rotary base, the developing can be made with a high degree of reliability even with the use of high density liquid developer which readily causes precipitation.

Explanation will be made of the liquid developer to be used. In this embodiment, the liquid developer having a toner temperature of 5 to 53 deg.C is used. The reason why such liquid developer is used will be hereinbelow explained.

Figure 7:
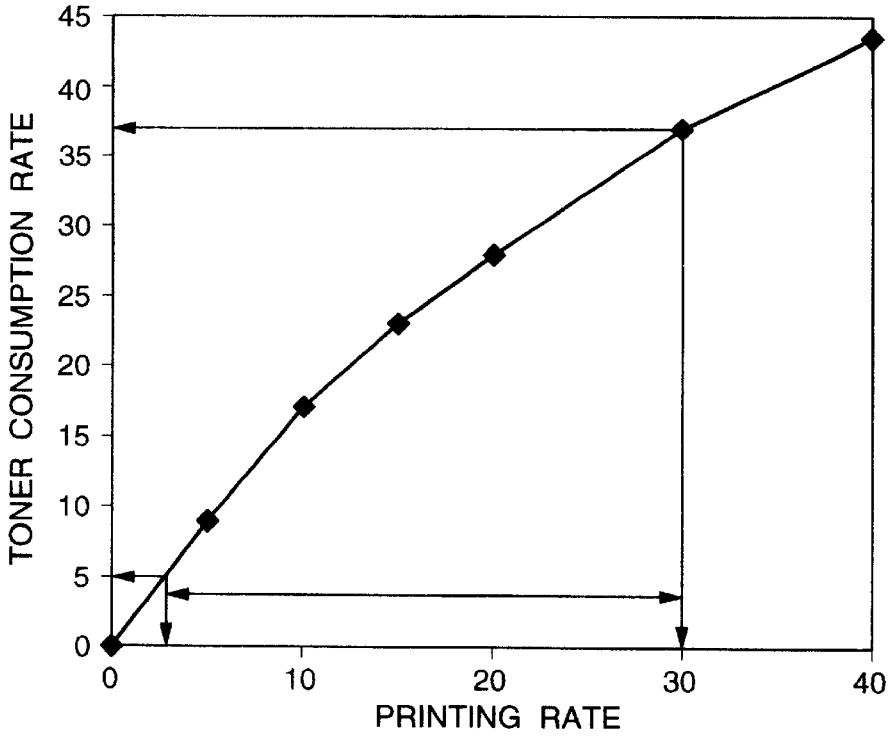
FIG. 7 is a view showing relationship between printing rate and toner consumption rate.

The printing rate (%) varies variously in accordance with image data. In the printer according to the present invention, which can carry out high density recording, the printing rate is estimated as 3 to 30% on average. The toner consumption rate in this condition is exhibited as shown in FIG. 7. It is noted that estimation is made such that isoper as a solvent sticks to a recording medium by a thickness of 0.5 $\mu$m. The weight of the liquid developer sticking to a A4-size sheet, is about 31 mg. It is noted that in view of testing made in an actual apparatus, it has been proved that this estimation is reasonable.

The averaged printing rate varies in a range from 3 to 30% depending upon how the apparatus is used. If recording having a printing rate of 20% is carried out with the use of liquid developer having a toner density of 10%, the toner density is gradually lowers. However, if the liquid developer can be sufficiently fed by the developing roller, it is possible to prevent the density of the image from lowering. However, finally, the liquid cartridge has to be replaced with new one even though a small quantity of solvent remains in the liquid developer cartridge.

In view of this fact it can be understood that the toner density should be set in accordance with a toner consumption rate in order to decrease the quantity of residue as possible as it can. Conventional liquid developer having a toner density of less than 1%, causes solvent to remain by a large quanity since the toner quantity is small, and further, the toner migrates in the solvent, the developing requires a long time since the degree of displacement is large when it sticks onto the electrostatic latent image during developing. As a result, the density of developing becomes low.

Thus, the weight percent of the toner is set to 5 to 35% equal to the averaged consumption rate of the toner corresponding to the averaged printing rate.

According to the present invention, it is possible to eliminate the necessity of an agitating device for preventing occurrence of precipitation and agglutination in the liquid developer, and it is possible to use liquid developer having a high density, thereby it is possible to carry out a highly fine recording, and to provide a small-sized and high speed recording apparatus.

What is claimed is:

1. A recording apparatus comprising:

a recording head for creating an electrostatic latent image on a recording medium in accordance with an image signal;

a conveyor roller for guiding and conveying the recording medium;

liquid type color developing units for developing the electrostatic latent image on said recording medium with the use liquid developer in which toner is dispersed;

wherein the toner dispersed in said liquid developer has a weight percent which is set to 5 to 35%, each of said color developing units has a cartridge tank for storing therein liquid developer and a developing roller, and said color developing units are arranged on a rotary base which is rotated so as to cause said liquid developer in a respective one of said cartridge tanks to be turned over and to be agitated sufficiently to enable proper development of the electrostatic latent image on said recording medium.

2. A recording apparatus comprising:

a recording head for creating an electrostatic latent image on a recording medium in accordance with an image signal;

a conveyer roller for guiding and conveying the recording medium;

liquid type color developing units for developing the electrostatic latent image on said recording medium with the use liquid developer in which toner is dispersed;

wherein the toner dispersed in said liquid developer has a weight percent which is set to 5 to 35%, each of said color developing units has a cartridge tank for storing therein liquid developer, a developing roller, a pump-up roller for pumping up the liquid developer onto said developing roller, and a supply passage for supplying a predetermined quantity of liquid developer from said cartridge tank to said pump-up roller in response to rotation of the developing units, and said color developing units are provided to a rotary base so that the developing units are to be used being changed over by rotating said rotary base.

3. A recording apparatus as set forth in claim 2, wherein each of said liquid type developing units includes a shut-off valve located in said flow passage on the liquid developer holder side.

4. A recording apparatus as set forth in claim 2, further comprising a rotary control part for rotating said rotary base by a degree greater than a half-turn just before a start of recording.

5. A recording apparatus as set forth in claim 2, further comprising a recovery passage, in addition to said supply passage, for returning a part of said liquid developer fed to said pump-up roller in each of the developing units, which remains on the developing unit side, into said cartridge tank in association with the rotation of said rotary base, and a counterflow preventing valve for preventing counterflow of the liquid developer from said cartridge tank into said recovery passage.

6. A recording apparatus as set forth in claim 2, wherein said recording head incorporates first and second electrodes forming through-holes, and a power source control part for controlling a field strength between said first and second electrodes, and the volume of ions passing through the through-holes are controlled by the power source control part so as to create an electrostatic latent image on the recording medium.

* * * * *